United States Patent [19]

Page

[11] Patent Number: 4,712,646

[45] Date of Patent: Dec. 15, 1987

[54] LINEMAN'S SAFETY STRAP ASSEMBLY

[76] Inventor: Lawrence J. Page, R.R. #4, Division Street North, Cobourg, Ontario, Canada, K9A 4J7

[21] Appl. No.: 25,592

[22] Filed: Mar. 13, 1987

[30] Foreign Application Priority Data

Jan. 12, 1987 [CA] Canada ..... 527131

[51] Int. Cl.[4] ..... A62B 35/00

[52] U.S. Cl. ..... 182/9

[58] Field of Search ..... 182/3-9, 182/187

[56] References Cited

U.S. PATENT DOCUMENTS

| | | | |
|---|---|---|---|
| 869,382 | 10/1907 | Newton | 182/9 |
| 1,120,496 | 12/1914 | Holsclaw | 182/9 |
| 2,853,220 | 9/1958 | Thomas | 182/3 |
| 2,920,714 | 1/1960 | Johnson | 182/9 |
| 3,407,898 | 10/1968 | Johnson | 182/9 |
| 3,840,091 | 10/1974 | Conlon | 182/9 |
| 4,579,196 | 4/1986 | Allen | 182/9 |

*Primary Examiner*—Reinaldo P. Machado
*Attorney, Agent, or Firm*—Ridout & Maybee

[57] ABSTRACT

A lineman's safety strap assembly is intended for attachment to a body belt. An elongated strap terminating in a buckle at one end for varying the length of the safety strip is provided with a first hook for coupling the safety strap to the body at the other end. A second hook for coupling the safety strap to the body belt is slidably mounted on the safety strap. An inclined sharp edged roller is slidably mounted on the safety strap for movement toward the midpoint of the strap. A cross belt terminating in spring-backed latches at both ends may be slidably coupled to the safety strap at two locations in order to form a closed loop for encircling the pole with the rollers facing inwardly. In the event of a fall, the cross belt bears against the inner face of the pole and the safety strap jams in the latches, while the lower edge of the roller is pulled into biting engagement with the outer face of the pole. The lower edges of the latches may also dig into the face of the pole. The assembly thus provides a braking feature in the event of a fall, but the configuration of the roller is such that it does not hinder the lineman in ascending or descending a wooden utility pole when the braking feature is not needed.

14 Claims, 6 Drawing Figures

LINEMAN'S SAFETY STRAP ASSEMBLY

BACKGROUND OF THE INVENTION

The present invention relates to improvements in a safety strap assembly for linemen.

A conventional lineman's safety strap, used in climbing wooden utility poles, consists of a belt worn around the lineman's body, provided with means, generally rings, for attaching an elongated strap. The strap, generally of a heavy but somewhat flexible material, passes around the far side of the pole and is generally attached to the rings on the body belt with hooks having a safety catch feature to prevent unintended uncoupling.

The lineman has inwardly directed spikes attached at his feet with which he pierces the pole at each step to secure his position. In order to quickly insert and retract his feet spikes at each step, the lineman generally adopts a side-to-side rolling motion climbing up and down the pole.

The safety strap provides additional support for the lineman as he climbs, and also frees his hands.

Safety problems arise when one or both of the lineman's spikes or gats do not make good contact with the wood of the pole for any number of reasons, causing the lineman to miss his footing and to fall. While the conventional safety strap provides support for the lineman on normal ascent and descent of the pole, it has no braking feature in the event of such a fall.

Modifications have been made in safety straps in an attempt to add safety braking features, for example in U.S. Pat. No. 2,920,714 - Johnson, U.S. Pat. No. 3,407,898 Johnson and U.S. Pat. No. 3,840,091 - Conlon.

However, the problem throughout has been the provision of a reliable braking feature which does not interfere with the lineman's normal ascent up and descent down the pole. Inwardly directed spikes attached to the safety strap and tightly encircling secondary straps added to the basic safety strap have been found to cause a hindrance to linemen in their normal "rolling" ascent and descent by catching on the pole even when not needed. The result has been that the linemen prefer to remove these safety braking features from their equipment, rather than face additional delays in their work in freeing the safety equipment constantly.

SUMMARY OF THE INVENTION

The present invention is therefore directed to providing a safety braking feature on a lineman's strap which minimizes the hindrance caused in normal ascent and descent of the utility pole.

According to the present invention, there is provided a lineman's safety strap assembly for attachment to a body belt, consisting of an elongated safety strap terminating in a buckle at one end for varying the length of the safety strap, and in first means for coupling the safety strap to the body belt at the other end. A second set of means for coupling the safety strap to the body belt is slidably mounted on the strap. An inclined sharp edged roller is slidably mounted on the safety strap for movement toward the midpoint thereof. A cross-belt terminates at both ends in means for slidably coupling the cross-belt to the safety strap at two locations, thereby forming a closed loop for encircling a utility pole with the roller facing inwardly. In the event of a fall, the cross-belt bears against the inner face of the pole while the lower edge of the roller is pulled into biting engagement with the outer face of the pole. Preferably, sharp lower edges defined on the latch means slidably coupling the cross-belt to the safety strap are simultaneously forced into biting engagement with the inner face of the pole.

Preferably, a second inclined sharp edged roller is mounted at the buckle end of the strap and may be moved to a position for contacting the pole on shortening the safety strap. In the event of a fall, the lower edges of both rollers will be pulled into biting engagement with the outer face of the pole.

Preferably, the cross-belt is adjustable in length to accommodate different pole widths. Means for slidably coupling the cross-belt to the safety strap include, on each such means, a frame having opposed protruding arms for receiving the safety strap between them. First and second posts laterally protrude from respective ends of the arms. A latch is pivotally mounted on the first post on one arm, and is spring-biased away from that arm. The latch also has a recess defined in its free end for receiving the second post. The latch is forced against its spring-bias to engage and disengage the second post from inside the recess for locking and releasing the latch.

Preferably, the means for slidably coupling the cross-belt to the safety strap also include a spring-backed wall slidably mounted between the opposed arms of the frame and biased toward the latch, defining, with the locked latch, a slot for receiving the safety strap. A stop limits sliding movement of the wall against its spring-bias, so that slidable movement of the safety strap through the slot is prevented when the strap is twisted or distorted, as in a fall. Sharp edges at the top and bottom of the slot also hinder slidable movement of the twisted or distorted strap through the slot.

DETAILED DESCRIPTION OF THE PREFERRED EMBODIMENTS

Figure 1:
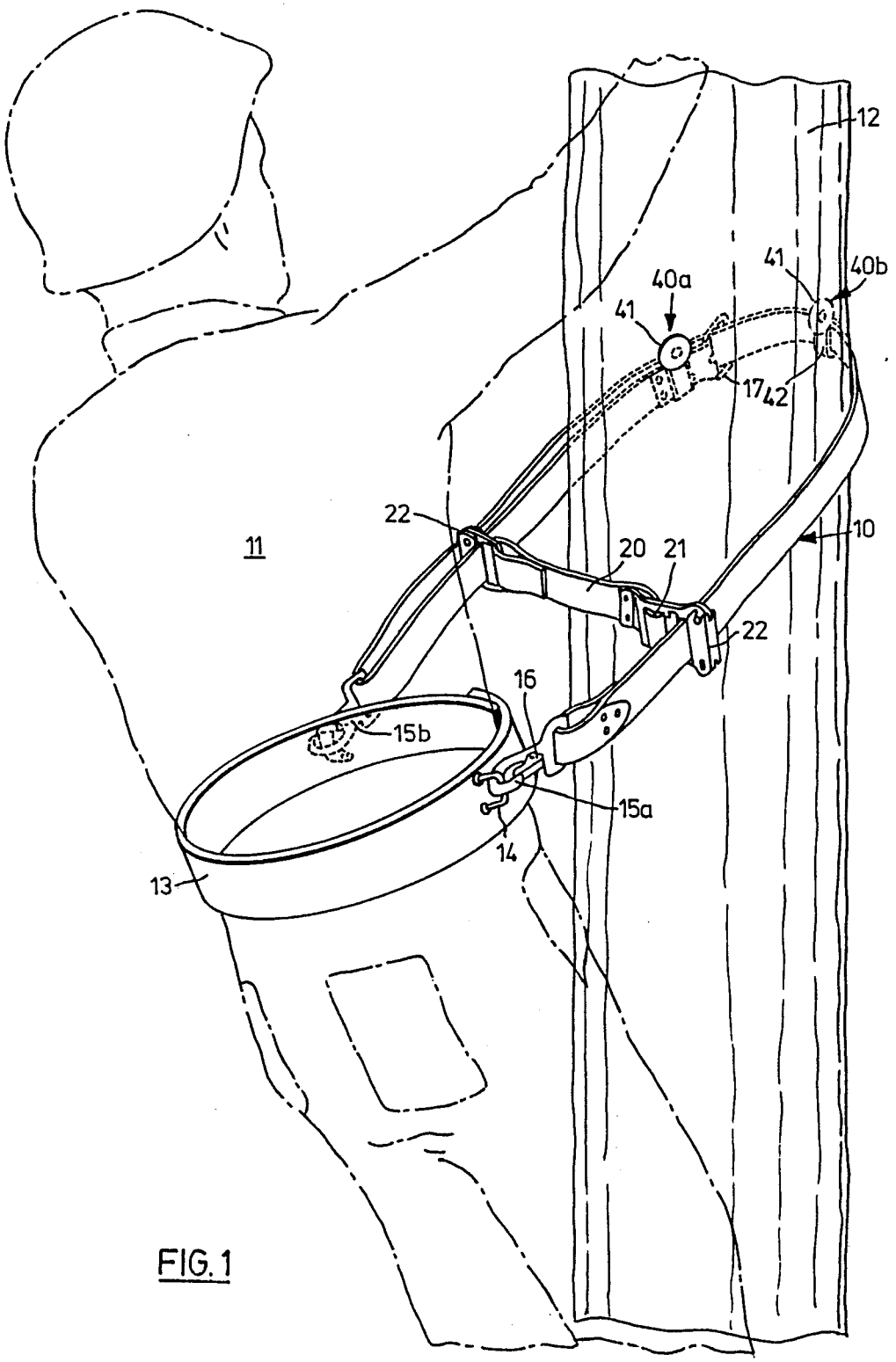
FIG. 1 shows the safety strap assembly comprising a safety strap and a cross belt, as worn by a lineman in use.
Figure 2:
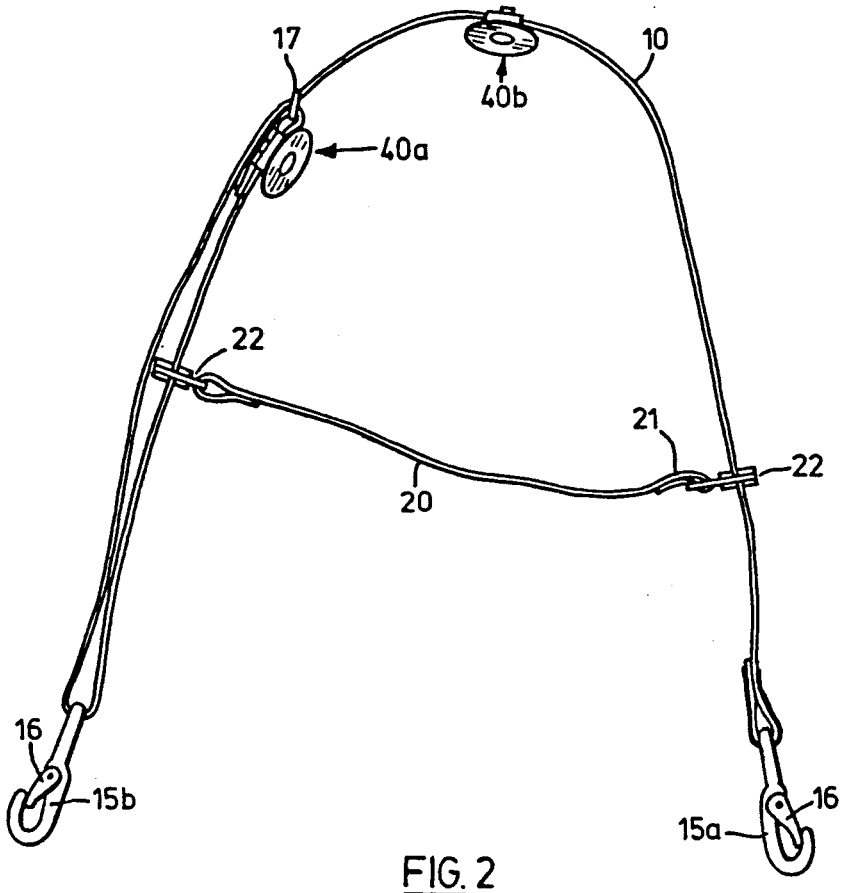
FIG. 2 is a plan view of the safety strap assembly showing its component parts.

FIG. 1 shows the safety strap 10 worn by a lineman 11 climbing a utility pole 12. The lineman wears conventional climbing equipment such as spikes (not shown) and a body belt 13. The body belt 13 is provided with attaching rings 14 on its opposite sides to which the safety strap is attachable.

The safety strap 10 is of conventional configuration and material, such as resin-treated latex nylon or Latigo leather, to provide a relatively stiff but flexible strap.

The strap is an elongated strip with a safety hook **15*a* mounted at one end for coupling with one of the attaching rings 14. The safety hook has a hinging tongue 16 preventing the hook from becoming unintentionally detached from the ring 14**.

A buckle 17 is mounted on the safety strap 10 at the opposite end from the safety hook 15*a* so that the strap may be doubled over and buckled to shorten it for use on poles of varying widths. In use of the present invention, the lineman should preferably use only holes extending to the midpoint of the safety strap.

A second safety hook 15*b* is slidably mounted on the safety strap 10 to be positioned at the end of the loop formed by doubling the safety strap 10, for coupling with the attaching ring 14 on the opposite side of body belt 13. As can be seen from FIG. 1, the safety hooks 15*a* and 15*b* are attached only after the lineman 11 has passed the safety strap 10 around the outer face of the pole 12. The lineman 11 then attaches the cross-belt 20 to the safety belt 10 across the inner face of the pole 12, lengthening or shortening it as required, preferably to maintain the cross-strap 20 about seven centimeters from the face of the pole 12 when the cross-strap is taut on weight being applied to the pole strap 10 during climbing.

The cross-belt may be of flexible nylon strapping or any other suitable material, and any conventional means appropriate to the material used, such as a slip buckle 21 in which the belt doubles back on itself, may be provided for lengthening or shortening the cross-belt.

Safety latches 22 are mounted on both ends of the cross-belt 20 for attachment to the safety strap 10.

Figure 4:
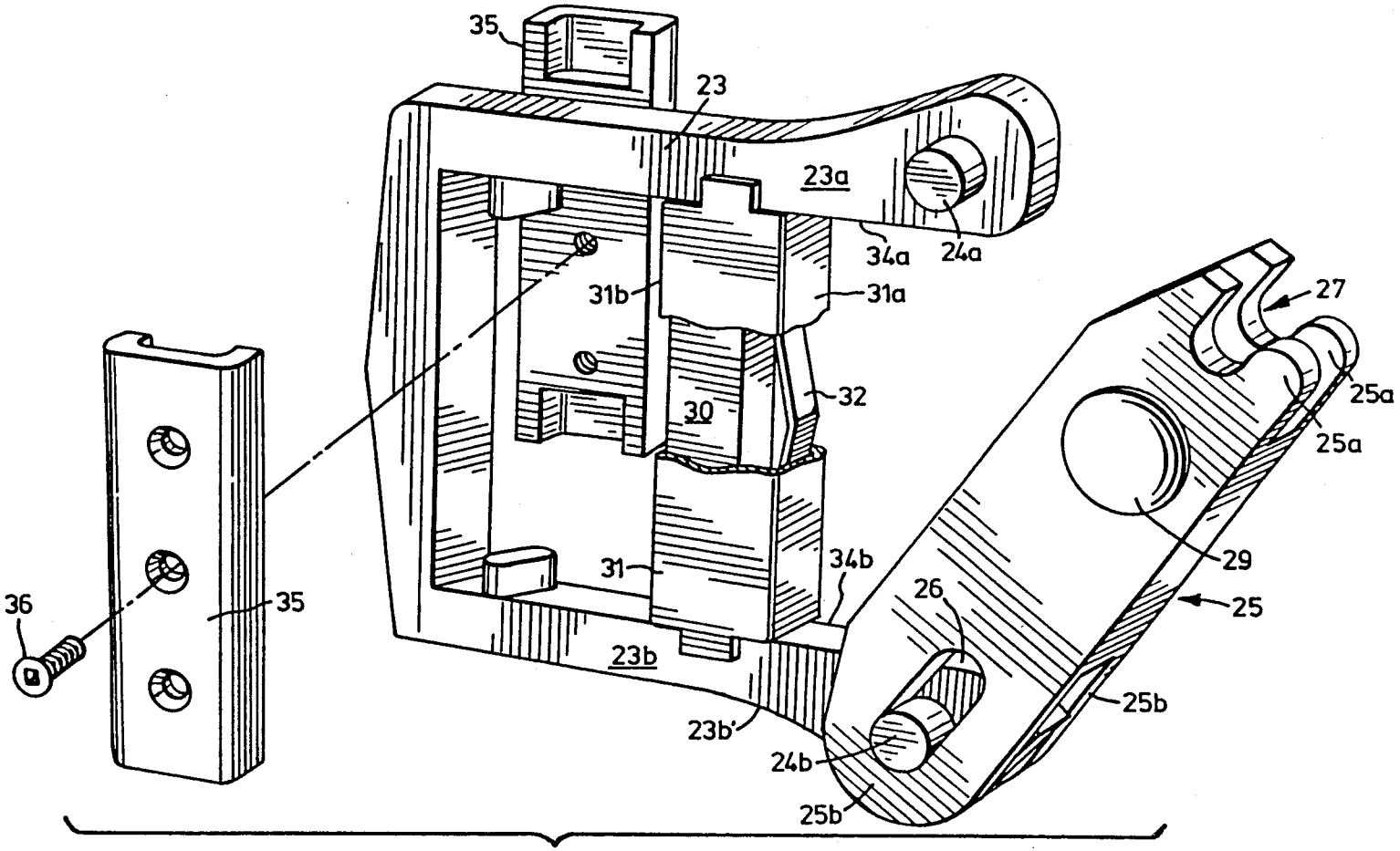
FIG. 4 is a partially exploded view showing the mode of attachment of the ends of the cross-belt to the safety strap in open position.

As shown in FIG. 4, the safety latch 22 comprises a U-shaped frame 23 having posts 24*a* and 24*b* extending through and protruding from opposed arms of the frame 23*a* and 23*b*. The lower arm 23*b* presents a sharp lower edge 23*b*'. A latch 25, having forked ends 25*a* and 25*b*, is provided with ovoid apertures 26 through both forks 25*b*. The latch 25 is pivotally mounted on frame 23 with the forks 25*b* straddling the end of the lower frame arm 23*b* and the posts 24*b* protruding through the ovid apertures 26 on either side to act as axes for the pivot.

Figure 5:
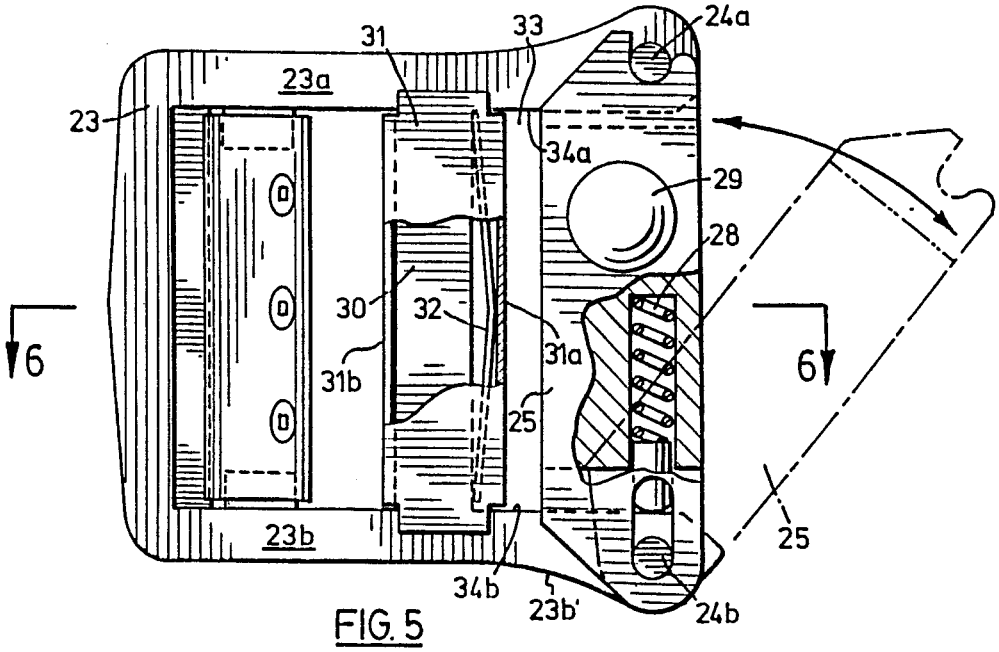
FIG. 5 is a partial cross-sectional view of the view of FIG. 4 in closed position, showing open position in phantom outline.
Figure 6:
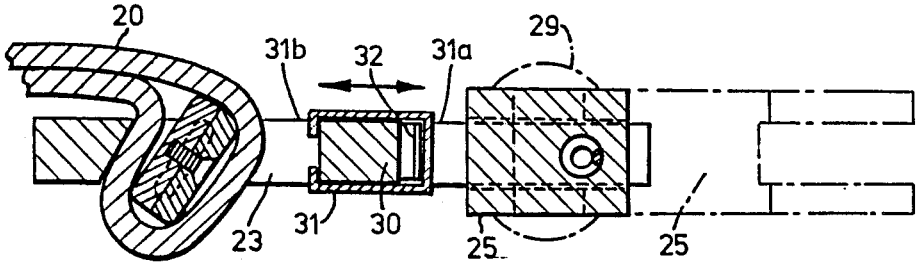
FIG. 6 is a section taken along line 6—6 in FIG. 5.

At the other end of the latch 25, a recess 27 is defined through both forks 25*a* for latching engagement with the posts 24*a* when the forks 25*a* straddle the end of the upper frame arm 23*a*, as shown in FIG. 5 and described hereafter.

The latch 25 is provided internally with a spring 28 which biases the latch 25 away from the posts 24*b*. When the spring 28 is fully extended, the forks 25*a* extend beyond the posts 24*a*, so that the latch 25 is locked. When the posts 24*a* are inside recess 27. A hemispherical knob 29 provides a finger/thumb grip for forcing the latch 25 to shift toward the posts 24*b* to allow the posts 24*a* to engage or disengage from within the recess 27.

As shown in FIG. 4, a stationary bar 30 bridges the two arms of the frame 23. The bar 30 is enclosed in a casing 31 which is slidably mounted between the two arms 23*a* and 23*b* of the frame 23. The casing 31, of greater depth than the bar 30, is capable of limited slidable movement between points where its front wall 31*a* and its rear wall 31*b* about the bar 30.

The front wall of the casing 31*a* is backed by a leaf spring 32 which biases it away from the bar 30, sliding casing 31 to the point where the rear wall of the casing 31*b* abuts the bar 30.

When latch 25 is in closed position, it defines a slot 33 with the front wall of the casing 31*a* for receiving and holding the safety belt. The slot 33 is narrower than the width of the safety belt, so that a constant force is exerted against the leaf spring 32 when a safety belt is held in the slot 33, thereby allowing only a frictional sliding of the safety latch 22 along the safety belt. When the safety belt is twisted, for example during a fall, it will jam in the slot 33 which will not be capable of sufficient widening to accommodate such a width. As a secondary hinderance against slippage, the slot 33 is provided with sharp top and bottom edges 34*a* and 34*b* over which a twisted or distorted strap will not be easily be passable. Once the safety belt has found its binding position, no further slippage will occur.

For ease of manufacture, the frame 23 may be stamp-formed, and the side plates 35 may be assembled using bolts 36 or screws, as shown in FIG. 4.

Referring to FIG. 1, the lineman's last task, prior to commencing his ascent of the pole, is to position the gripping means 40*b* to the midpoint of the safety strap, on the far side of the pole 12, prior to commencing his ascent.

Gripping means 40*a*, which is mounted in place on the safety belt 10 adjacent the buckle 17, may also be adjacent a face of the pole if the pole is narrower and the safety strap has been shortened.

Figure 3:
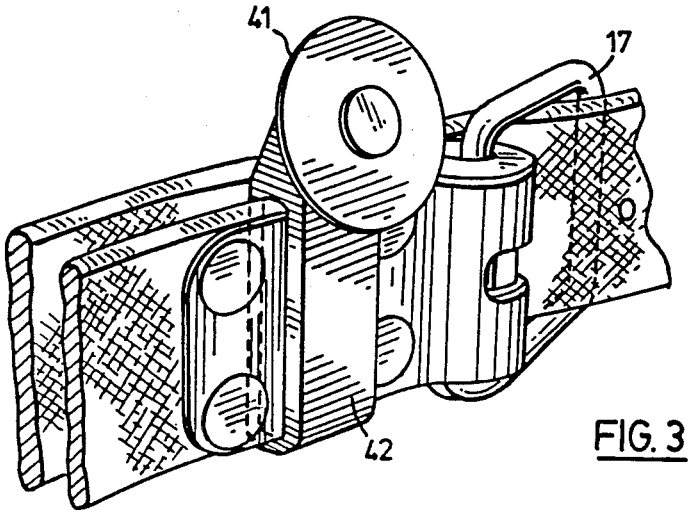
FIG. 3 shows a detail of the safety strap.

As shown in detail in FIG. 3, each gripping means is provided with a sharp edged roller 41 mounted at an incline on the bracket 42. In the case of the gripping means 40*a*, its bracket 42 is forced onto a doubled portion of the strap 10 provided for attaching the buckle 17, and the gripping means 40*a* is thus stationary on the safety strap 10.

The gripping means 40*b*, of identical construction, is mounted on a single-width portion of the strap 10, and is slidable along the strap 10, although preferably in a somewhat frictioned slide. To accommodate different belt widths, a spring can be mounted inside the bracket 42*a* of gripping means 40*b* to achieve a uniform frictional slide.

As seen from FIG. 1, the safety strap 10 should encircle the pole 12 so that the rollers 41 face inwardly toward the pole, with the lower edge of each roller being closest in proximity to the pole surface.

On the lineman's normal ascent and descent of the pole 12, the rollers 41 freely revolve horizontally, which prevents any catching or hindrance as long as the experienced lineman uses the side-to-side rolling motion described above.

In the event of a fall straight down the pole, frictioned resistance against the safety strap 10 allows the lineman 11 to fall below the safety strap 10 and cross-belt 20. The cross-belt 20 bears against the inner face of the pole and the strap 10 twists, pulling the sharp lower edges of the rollers into biting engagement with the outer face of the pole 12. Concurrently, the cross-belt 20 bears against the inner face of the pole, forcing the sharp lower edges 23*b*' of both safety latches into biting engagement with the inner face of the pole, to act as a secondary braking against the lineman's fall.

The engagement of the roller of gripping means 40*b*, and also of gripping means 40*a*, if applicable, in the wood on the far face of the pole breaks the lineman's fall. Twisting of the strap 10 jams against any further sliding through latching means 22, thus preventing any slippage, while the lineman has an opportunity to steady himself and gain his footing with his feet spikes once again.

In the case of a larger than average pole, such as two poles together, the strap 10 will be extended to its full length, and the buckle 17, along with the gripping means 40*a* will be positioned adjacent the safety hook 15*b*. In this position, the gripping means 40*a* will be useless, since it will have no effective contact with the pole, and all braking will be provided by the gripping means **40*b* positioned opposite the lineman 11 at the rear of the pole 12**.

I claim:

1. A lineman's safety strap assembly for attachment to a body belt, comprising:

an elongated safety strap terminating in a buckle at one end for varying the length of the safety strap, and in first means for coupling the safety strap to the body belt at the other end of the safety strap, second means for coupling the safety strap to the body belt being slidably mounted on said safety strap;

an inclined sharp edged roller slidably mounted on the safety strap for movement toward the midpoint thereof; and a cross-belt terminating in means at both ends for slidably coupling the cross-belt to the safety strap at two locations, thereby forming a closed loop for encircling a pole with the roller facing inwardly, whereby in the event of a fall, the cross-belt bears against the inner face of the pole while the lower edge of the roller is pulled into biting engagement with the outer face of the pole.

2. A lineman's safety strap assembly, according to claim 1, further comprising a second inclined sharp edged roller mounted at the buckle end of the safety strap, whereby on shortening the safety strap, the second roller will be pulled into biting engagement with the outer face of the pole spaced from and concurrently with the first roller.

3. A lineman's safety strap assembly, according to claim 1, wherein the cross-belt is adjustable in length to accommodate different pole widths.

4. A lineman's safety strap, according to claim 1, wherein each means for slidably coupling the cross-belt to the safety strap comprise:

a frame having opposed protruding arms for receiving the safety strap therebetween, and first and second posts laterally protruding from respective ends of the arms; and a latch pivotally mounted on the first post on one arm and spring-biased away from said arm, the latch having a recess defined in its free end for receiving the second post, whereby the latch may be forced against its spring-bias to engage and disengage the second post from inside the recess, whereby to lock and release the latch.

5. A lineman's safety strap, according to claim 4, wherein the latch has defined at one end opposite the free end an aperture, and wherein the first post extends through said aperture for pivotally mounting the latch on the frame.

6. A lineman's safety strap, according to claim 5, wherein the aperture defined in the latch is ovoid.

7. A lineman's safety strap, according to claim 4, 5 or 6, wherein the first and second posts laterally protrude from both sides of the arms, and wherein the latch is provided with forked ends for straddling the arms of the frame in engaging the first and second posts.

8. A lineman's safety strap, according to claim 4 wherein each frame presents a sharp lower edge, positioned so that in the event of a fall, when the cross-belt ears against the inner face of the pole, the sharp lower edge of the frame is forced into biting engagement with said inner face.

9. A lineman's safety strap assembly, according to claim 4, wherein the means for slidably coupling the cross-belt to the safety strap further comprising:

a spring-backed wall slidably mounted between the opposed arms of the frame and biased toward the latch, defining therebetween a slot for receiving the safety strap on locking the latch; and a stop for limiting sliding movement of the wall against its spring-bias, whereby to prevent slidable movement of the safety strap through the slot when the safety strap is twisted.

10. A lineman's safety strap, according to claim 9, wherein the stop comprises a bar extending between the opposed arms of the frame behind the wall.

11. A lineman's safety strap, according to claim 10, further comprising a casing slidably mounted between the opposing arms of the frame and enclosing the bar, the casing presenting a face defining said wall.

12. A lineman's safety strap, according to claim 9, wherein the wall is backed by a leaf spring.

13. A lineman's safety strap, according to claim 9, wherein the slot is narrower than the width of the safety strap, whereby to provide a frictional restraint on sliding of the safety strap through the slot.

14. A lineman's safety strap, according to claim 9, wherein the opposed arms of the frame defining the slot therebetween have sharp edges over which the safety strap passes, which sharp edges further hinder slidable movement of the safety strap through the slot when the safety strap is twisted.

* * * * *